US006456569B1

(12) United States Patent
Stauffer

(10) Patent No.: US 6,456,569 B1
(45) Date of Patent: Sep. 24, 2002

(54) MUTUAL MOUNTING OF A CRYSTAL, A DIAL AND A CASING RING FOR A TIMEPIECE

(75) Inventor: Philippe Stauffer, Neuchâtel (CH)

(73) Assignee: Eta SA Fabriques d'Ebauches (CH)

( * ) Notice: Subject to any disclaimer, the term of this patent is extended or adjusted under 35 U.S.C. 154(b) by 0 days.

(21) Appl. No.: 09/556,296

(22) Filed: Apr. 24, 2000

(30) Foreign Application Priority Data

Apr. 22, 1999 (EP) ..... 99107974

(51) Int. Cl.[7] ..... G04B 19/06; G04B 37/00; G04B 39/00

(52) U.S. Cl. ..... 368/236; 368/294; 368/296

(58) Field of Search ..... 368/88, 276, 294–296, 368/314, 228, 236

(56) References Cited

U.S. PATENT DOCUMENTS 4,924,452 A * 5/1990 Meyrat et al. ..... 368/236
5,043,957 A * 8/1991 Kaelin ..... 368/300
5,703,837 A 12/1997 Umemoto et al. ..... 368/88

FOREIGN PATENT DOCUMENTS

| | | | |
|---|---|---|---|
| EP | 0549978 | * | 7/1993 |
| FR | 2038181 | | 1/1971 |
| WO | WO93/19402 | * | 9/1993 |

OTHER PUBLICATIONS

DE 70 04 514 U (Horl), p. 3, line 25; p. 4, line 3, Fig. 1.

DE 70 00 980 U (Blessing–Werke, KG), p. 4, line 9–22, Figs. 5 and 6.

* cited by examiner

*Primary Examiner*—Vit Miska
(74) *Attorney, Agent, or Firm*—Griffin & Szipl, P.C.

(57) ABSTRACT

In order to angularly position and centre the crystal (5) with respect to the dial (4), the dial is provided with at least one lug (8) capable of being introduced precisely into a hollow (11) made in a collar (10) of the crystal (5). Thus, if the crystal has a lens (41) and the dial (4) has a window (40), the lens will be superposed exactly on said window.

3 Claims, 5 Drawing Sheets

MUTUAL MOUNTING OF A CRYSTAL, A DIAL AND A CASING RING FOR A TIMEPIECE

The present invention relates to a timepiece including a movement mounted in a casing ring, a dial mounted above the ring, a crystal mounted above the dial and means for securing the crystal onto a case.

Several documents describe ways of mounting the aforecited elements in relation to each other.

Swiss Patent No. CH 499 813 concerns a device for fixing a watch movement in its case. This document indicates that in order to secure the dial, it can be held by step fitting its outer periphery in a notch of the casing ring. As this known device has the drawback of being ill suited to modern assembly line production, the document cited proposes a dial provided with lugs allowing the dial to be centred, the dial being introduced into a notch arranged in the top part of the casing ring. In order to allow centring, the ring also has, in its top part, recesses corresponding to the lugs of the dial. Thus, in this embodiment, angular positioning and accurate centring of the dial is obtained with respect to the ring. However, no means are indicated which allow the crystal to be angularly positioned and centred with respect to the dial, since the crystal simply rests in a notch of a middle part-bezel.

European Patent No. EP 0 549 978 discloses a timepiece including means for the angular positioning of a crystal on a case. These angular positioning means are formed, on the one hand, by a notch arranged directly in an edge of the crystal and, on the other hand, by a projecting portion which is directly arranged on the middle part of the case and which is engaged in said notch. By bringing the crystal onto the middle part and by rotating the notch and projecting portion until they coincide, they engage angularly with each other and the crystal is eventually secured to the case. Here too, although using means which are close to those which will be described hereinafter, there is no question of positioning the crystal angularly with respect to the dial.

It will further be mentioned that welding the dial by means of three studs emerging from the casing ring is known from certain Swatch (registered trade mark) watches. There again, there is no question of orienting and centring the crystal with respect to the dial.

German Patent No. DE 70 04 514 U discloses a mutual mounting of a dial and a case for a timepiece. In one embodiment, the crystal is provided with a shoulder under which are integrated projecting portions of cylindrical shape. These projecting portions pass through first holes made in the dial, then second holes made in the case to be driven finally into sleeve tubes. It goes without saying that this construction allows the crystal to be angularly positioned and centred with respect to the dial and with respect to the case. However, it will be observed that this mounting system is cumbersome because of the space which it requires lengthways. It should also be noted that the purpose of this system is to secure the crystal onto the dial, then onto the case but not to orient it with respect to these components. As will be seen in the following description, the crystal according to the present invention is secured to the case by other means than those which orient it with respect to the dial.

The necessity of centring and angularly positioning the crystal with respect to the dial exists in numerous circumstances two of which will be provided here by way of example.

If the movement has a date ring whose figures appear in turn behind a window arranged in the dial and if the crystal has a lens for enlarging these figures, it is clear that it is imperative that the lens is located exactly opposite the window. This requires very precise positioning of the crystal with respect to the dial.

If the hour index or the figures indicating the hours are transferred onto the inner wall of the crystal, it is also clear that the dial on which the hands rotate has to be carefully positioned with respect to the crystal. The transfers applied to the crystal could also be various signs or a trade mark, and thus very precise positioning of the crystal with respect to the dial is required.

In the case of the aforecited Swiss Patent No. CH 499 813, manual intervention is required to orient the crystal properly with respect to the dial. In the case of the aforecited European Patent No. EP 0 549 978, since the crystal is oriented with respect to the case, it is the dial which would have to be able to be oriented with respect to the case. One can well imagine that such manual orientation is not suited to the automatic assembly of a timepiece. Finally, in the case of the German Patent No. DE 70 04 514, if such orientation of the crystal with respect to the dial exists solely because of the need to secure the crystal on the case, the construction proposed is complicated, expensive and cumbersome.

In order to answer these requirements, the timepiece according to the present invention is characterised in that the dial includes at least one lug projecting from its flank and in that the crystal is provided with an annular shoulder resting on the dial and a collar surrounding the flank of said dial, this collar being provided with at least one hollow arranged so as to cap said lug in order position angularly and to centre the crystal with respect to the dial.

The features and advantages of the invention will appear more clearly upon reading the following detailed description made with reference to the annexed drawings purely by way of example and in which.

Figure 1:
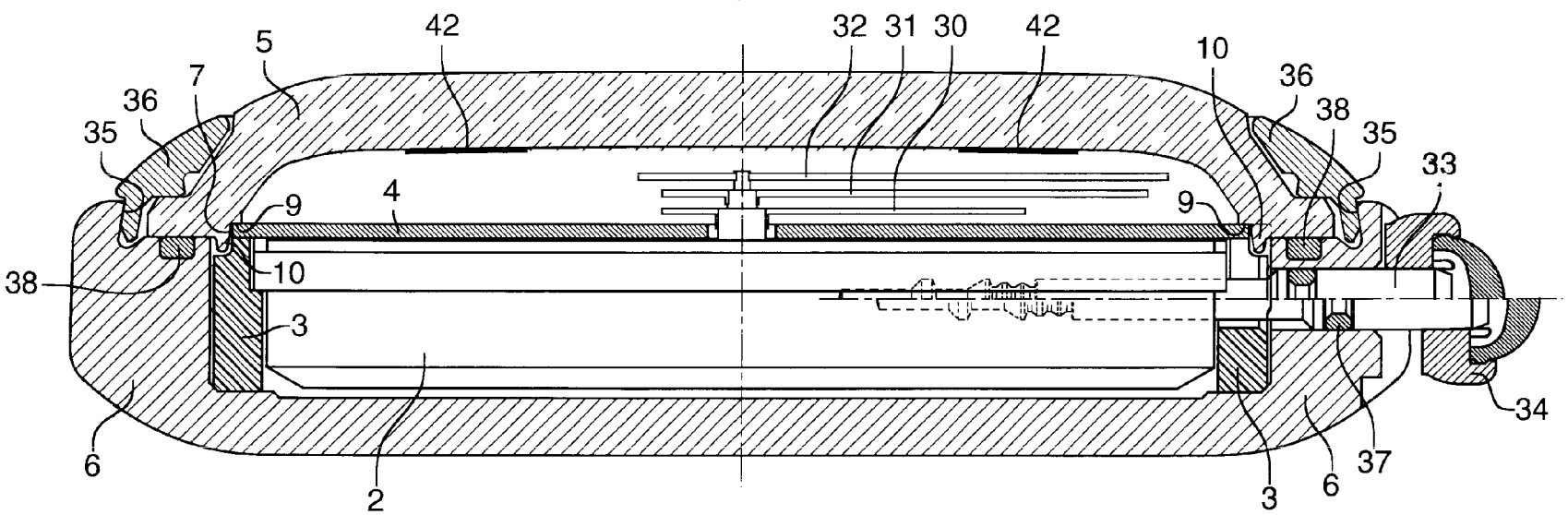
FIG. 1 is a general cross-section showing the timepiece according to the present invention.

The timepiece of the invention is shown in cross-section in FIG. 1. It includes a movement 2 mounted in a casing ring 3, a dial 4 mounted on ring 3 and a crystal 5 mounted above dial 4. Crystal 5 is secured to a case 6 by means 36 which will be described hereinafter. More particularly, movement 2 is provided with hands for the hours 30, minutes 31 and seconds 32 rotating between dial 4 and crystal 5. Movement 2 also includes a time-setting stem 33 on which a crown 34 is fitted. The sealing of stem 33 as regards case 6 is assured by an O ring sealing gasket 37. Case 6 is of the single piece type and includes on its top periphery a notch 35 in which a bezel 36 is engaged, the latter securing crystal 5 on case 6. Crystal 5 is made water tight with respect to case 6 as a result of the use of a sealing gasket 38 wedged between the crystal and the case. Dial 4 and crystal 5 are provided with means each other which fit together to angularly position and centre crystal 5 with respect to dial 4.

Preferred means for assuring such angular positioning and centring will now be described.

Figure 2:
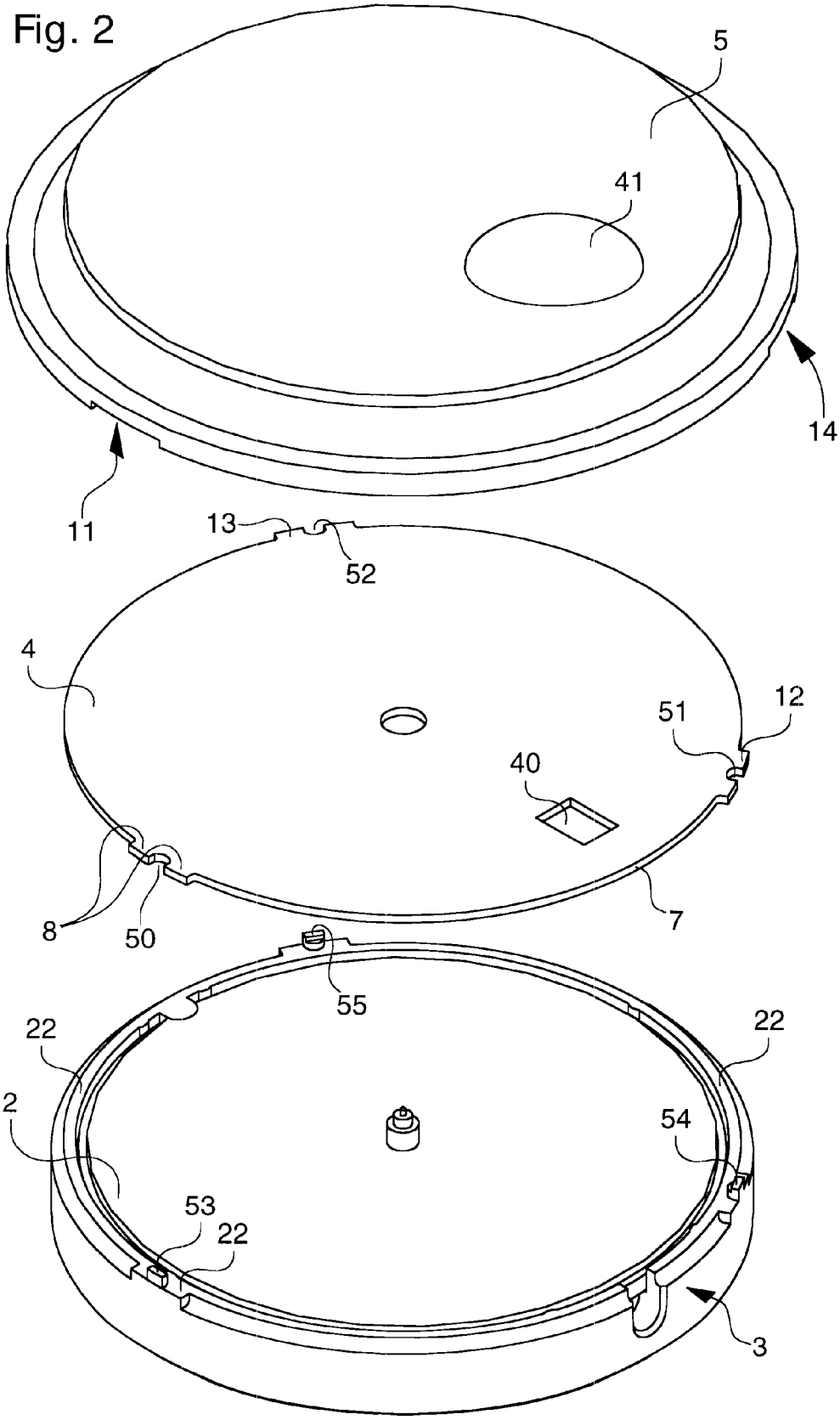
FIG. 2 is an exploded perspective top view of the assembly formed by the movement, the casing ring, the dial and the crystal, this assembly being assembled according to the present invention.
Figure 3:
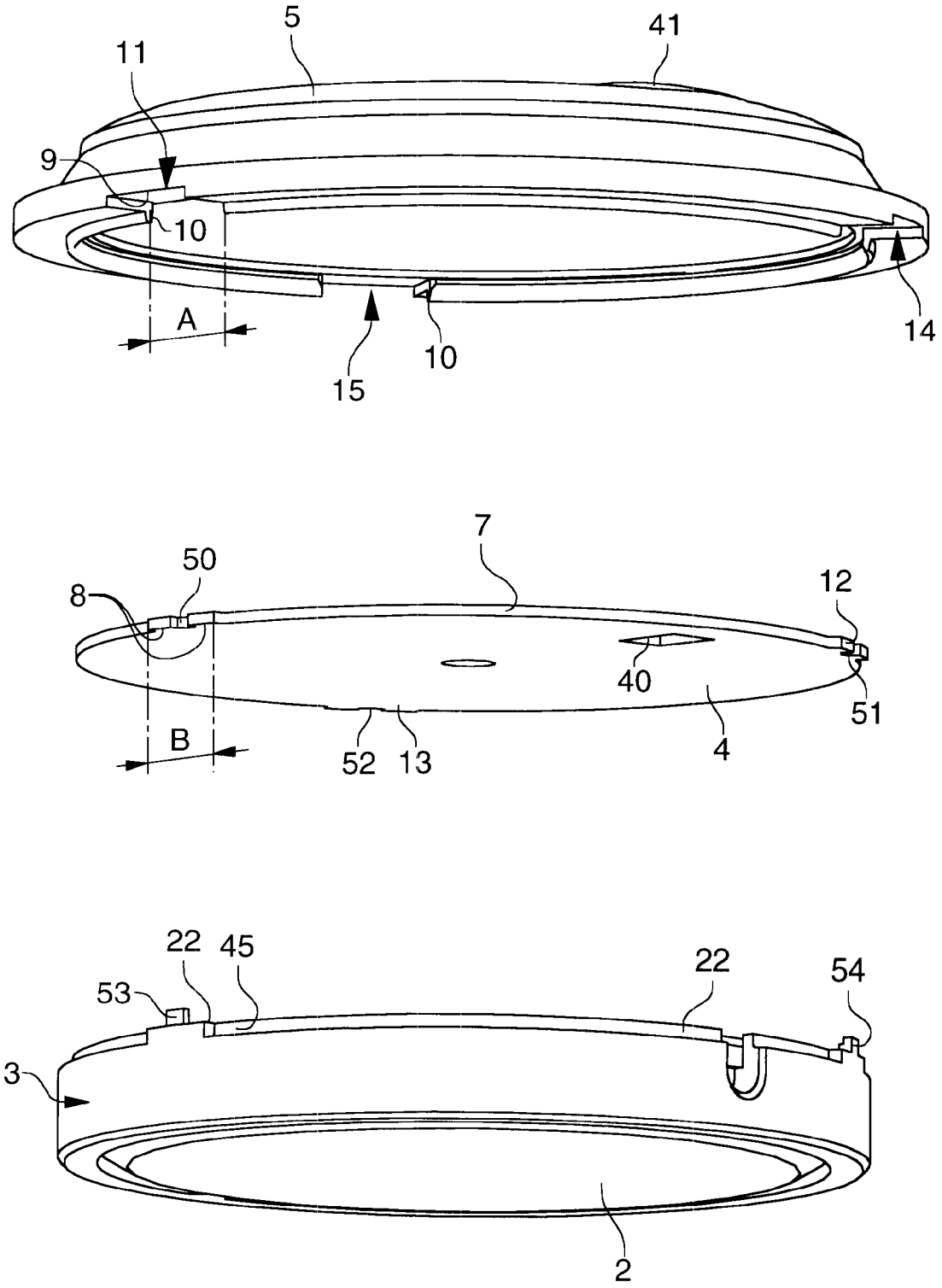
FIG. 3 is an exploded perspective bottom view of the same assembly as that shown in FIG. 2.

FIG. 2 and 3 are respectively top and bottom views of ring 3, dial 4 and crystal 5 shown in exploded perspective. These Figures show casing ring 3 in which movement 2 is housed. Dial 4 is mounted on ring 3. Crystal 5 is in turn mounted on dial 4. The Figures show that dial 4 has a flank 7 from which emerges at least one lug 8 which projects from the periphery of the dial. As is clear in FIGS. 1 and 3, crystal 5 is provided with an annular shoulder 9 which rests on dial 4 and a collar 10 which surrounds flank 7 of the dial. This collar 10 is provided with at least one hollow 11 arranged to cap lug 8. Thus the means which mutually fit together to angularly position and centre crystal 5 with respect to dial 4 consist, in the preferred embodiment of the invention, in overlapping hollow 11 of the crystal with lug 8 of dial 4.

FIGS. 2 and 3 show that dial 4 is provided with a window 40 through which the figures of a date ring (not shown) of movement 2 appear in turn. The same Figures show that crystal 5 is provided with a lens 41 for enlarging the figures appearing through window 40. It is clear that as a result of the construction described in the above paragraph, lens 41 is exactly above window 40. As a result of this construction, it is also clear that if the inside of crystal 5 has indices 42 or hour figure transfers, the location of these transfers will correspond exactly to hands 30, 31 and 32 rotating above dial 4 (see FIG. 1).

Figure 4:
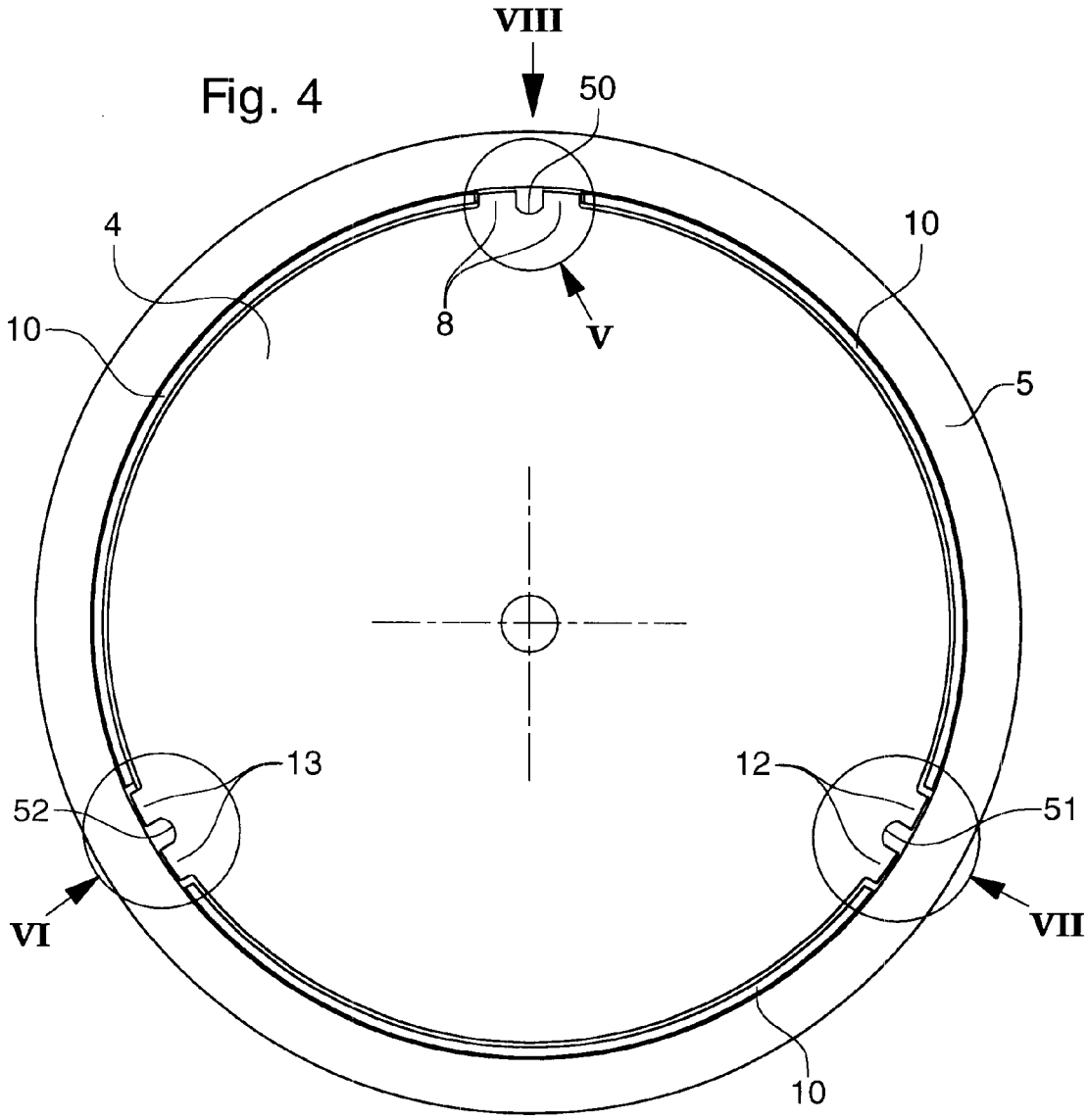
FIG. 4 is a plan view of the casing ring on which the dial is mounted.
Figure 5:
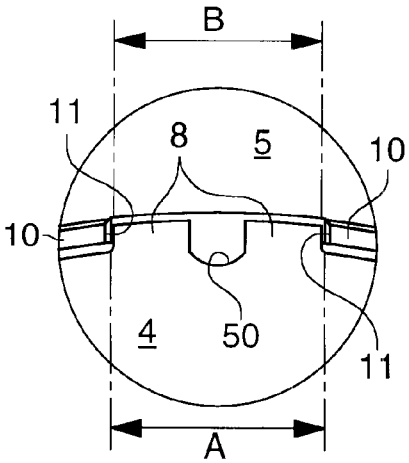
FIG. 5 is an enlargement of zone V of FIG. 4.
Figure 6:
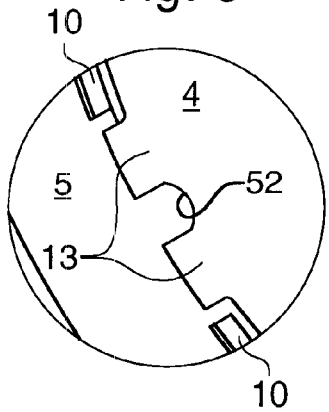
FIG. 6 is an enlargement of zone VI of FIG. 4.
Figure 7:
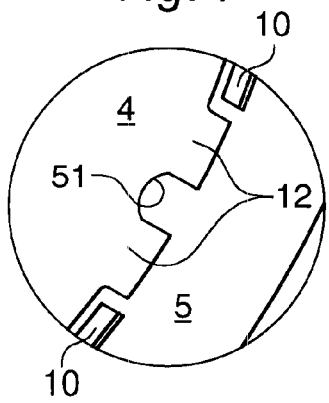
FIG. 7 is an enlargement of zone VII of FIG. 4.

For practical construction and mounting reasons, one preferred to provide dial 4 with three lugs instead of a single one. Thus, in addition to first lug 8 which was discussed hereinbefore, dial 4 is provided with a second lug 12 and a third lug 13, these three lugs being distributed at equal distances over the periphery of the dial. Two corresponding hollows 14 and 15 made in crystal 5 (see FIGS. 2 and 3) naturally correspond to the two additional lugs 12 and 13, the new hollows capping the new lugs. In order to avoid any play between the crystal and the dial and in order to facilitate the mounting of said crystal on said dial, the width of at least one hollow has to correspond substantially to the width of the lug which it caps. FIGS. 4 to 7 illustrate the foregoing. FIG. 4 is a bottom view of crystal 5 in which dial 4 is mounted. Zone V of this Figure, enlarged in FIG. 5, shows that there is no play as such between width B of lug 8 of dial 4 and the distance A which separates the interruption to collar 10 which forms hollow 11 of crystal 5, the width of this interruption corresponding to the width of hollow 11 made in the crystal. If reference is now made to FIGS. 6 and 7 which are enlargements of zones VI and VII of FIG. 4, it is seen that the play between the width of lugs 12 and 13 and the distance which separates the interruption to collar 10 in which lugs 12 and 13 respectively take their place, is greater. This allows easier mounting of the crystal without adversely affecting the perfect centring thereof with respect to the dial.

It was seen above that the essential purpose of lugs 8, 12 and 13 is to allow perfect angular positioning and centring of crystal 5 with respect to dial 4. However, advantage can be taken of the presence of these lugs to secure and angularly position dial 4 with respect to casing ring 3.

Figure 8:
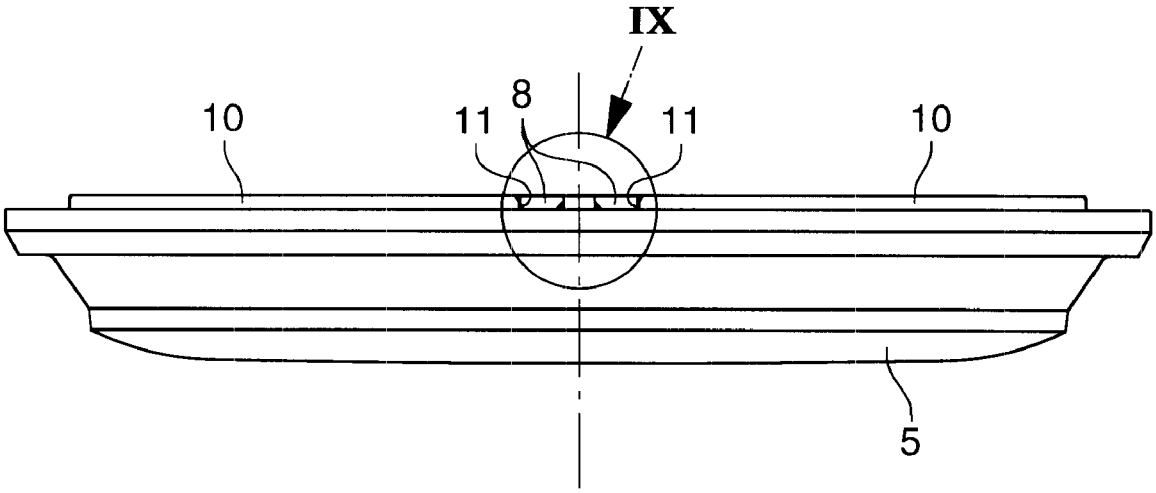
FIG. 8 is a profile view of the crystal along the arrow VIII of FIG. 4.
Figure 9:
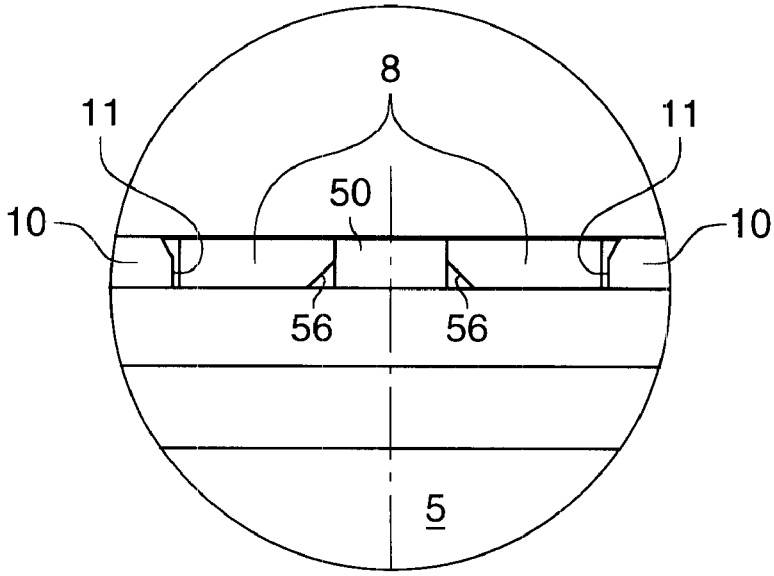
FIG. 9 is an enlargement of zone IX of FIG. 8.

For this purpose, FIGS. 2 to 8 show that lugs 8, 12 and 13 each have a notch referenced 50, 51 and 52 respectively. These notches are each arranged to accommodate a corresponding stud raised on the top face 22 of casing ring 3. Thus stud 53 corresponds to notch 50, stud 54 to notch 51 and stud 55 to notch 52. When the dial is applied onto the ring, the studs of the ring penetrate the respective notches of the dial lugs. In order to secure the dial definitively onto the ring, the studs are heat crushed and the top ends thereof project onto chamfers made in the notches. FIG. 8 shows crystal 5 shown in profile. As is clearly seen in FIG. 9 which is an enlargement of zone IX of FIG. 8, notch 50 of lug 8 has chamfers 56 in which the material of studl 53 will be housed to anchor the dial firmly onto the ring. It is understood here that the lugs of the dial then have two functions: that of orienting the crystal with respect to the dial and that of securing and orienting the dial with respect to the ring.

Securing dial 4 at three equidistant points can be understood in that if there were only one fixing point, the dial could be raised and not perfectly applied onto casing ring 3.

What is claimed is:

1. A timepiece including a movement mounted in a casing ring, a dial mounted above the ring, a crystal mounted above the dial and means for securing the crystal onto a case, wherein the dial includes at least one lug projecting from its flank and wherein the crystal is provided with an annular shoulder resting on the dial and a collar surrounding the flank of said dial, said collar being provided with at least one hollow arranged so as to cap said lug in order to position angularly and to centre the crystal with respect to the dial.

2. A timepiece according to claim 1, wherein the dial includes three lugs distributed at equal distances over the periphery of the dial and wherein the collar is provided with three hollows arranged to cap the corresponding lugs of said dial, the width of at least one hollow substantially corresponding to the width of a lug to prevent any angular play between the crystal and the dial.

3. A timepiece according to claim 2, wherein each lug includes a notch arranged to accommodate a corresponding stud raised on the top face of the casing ring to secure and angularly position the dial with respect to said ring.

* * * * *